US006185892B1

(12) United States Patent
Calvanella

(10) Patent No.: US 6,185,892 B1
(45) Date of Patent: Feb. 13, 2001

(54) PROCESS FOR MANUFACTURING SHEETS OR PLATES HAVING A LENTICULAR DOT OR LINE DECORATION IN PLASTIC AND/OR PAINT: DEVICE AND PRODUCT

(76) Inventor: Marco Calvanella, Via Gaiche, 24, 06066 Piegaro (PG) (IT)

( * ) Notice: Under 35 U.S.C. 154(b), the term of this patent shall be extended for 0 days.

(21) Appl. No.: 09/023,648

(22) Filed: Feb. 2, 1998

(30) Foreign Application Priority Data

Feb. 14, 1997 (IT) ..... MI97A0317

(51) Int. Cl.[7] ..... A47G 1/00; E04C 2/54
(52) U.S. Cl. ..... 52/311.1; 52/785.1
(58) Field of Search ..... 52/311.1, 780, 52/783.1, 785.1, 786.13, 800.1, 800.12

(56) References Cited

U.S. PATENT DOCUMENTS 2,040,863 * 5/1936 MacDonald et al. ..... 52/311.1 X
2,186,643 * 1/1940 Kaplan ..... 312/204 X
3,076,294 * 2/1963 Schiessl ..... 52/311.1 X
4,798,695 * 1/1989 Redel ..... 52/786.13 X
5,270,084 * 12/1993 Parker ..... 52/786.13 X
5,783,264 * 7/1998 Howes ..... 52/311.1 X

* cited by examiner

*Primary Examiner*—Carl D. Friedman
*Assistant Examiner*—Kevin D. Wilkens
(74) *Attorney, Agent, or Firm*—Sheridan Ross P.C.

(57) ABSTRACT

On a sheet of plastic material or plate of glass, transparent or translucent, colored or otherwise, decorations in paint or plastic material, in the form of lenticular dots or flat dots or lines are applied by way of a "cliché" provided with conical points or ridge shapes, previously immersed in a paint or plastic and then applied to the sheet or plate. A plurality of sheets thus decorated can be assembled with or without distance pieces and set in a frame, to form a decorative panel.

26 Claims, 4 Drawing Sheets

FIG. 1
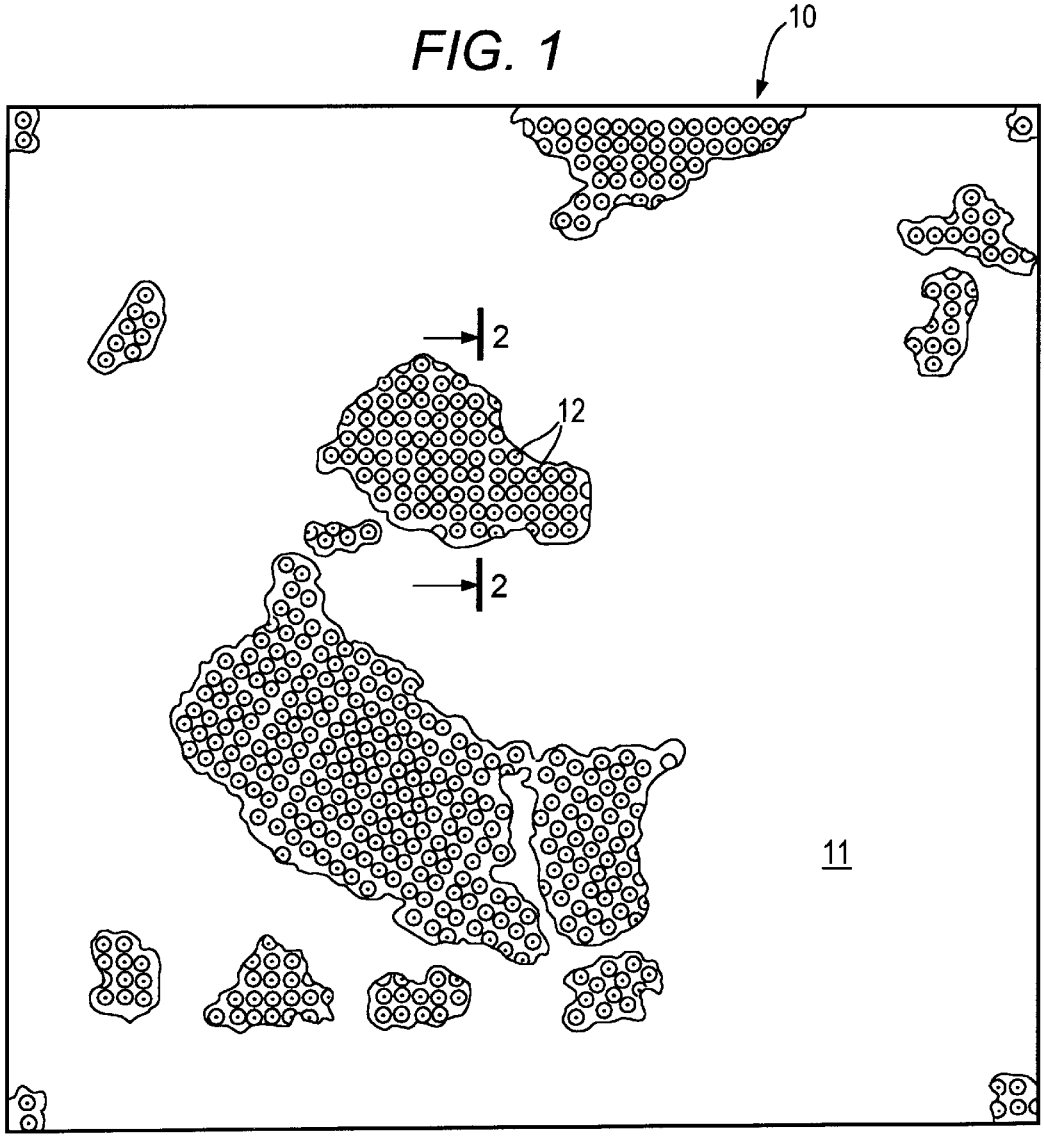
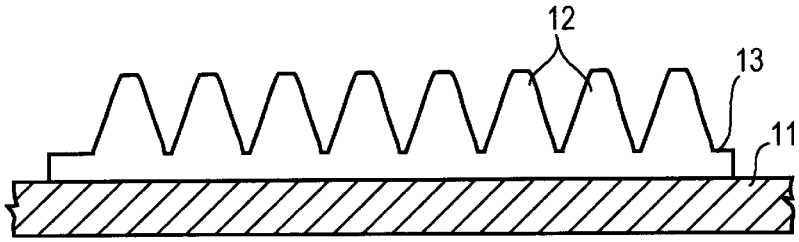
FIG. 2

PROCESS FOR MANUFACTURING SHEETS OR PLATES HAVING A LENTICULAR DOT OR LINE DECORATION IN PLASTIC AND/OR PAINT: DEVICE AND PRODUCT

FIELD OF THE INVENTION

The present invention relates generally to a process for manufacturing a decorated sheet or plate and specifically to a process for manufacturing a decorated sheet or plate in which the decorations are applied in liquid or semiliquid form.

DESCRIPTION

The object of the present application is to obtain a new product for ornamental use and interior decoration, in a practical, rapid manner that can be applied industrially.

The subject matter of the present invention is a process as described herein. A product and a device as described herein also form the subject matter of the present invention.

According to the new process, a base plate or sheet of transparent or translucent plastic material or glass is prepared, for example a sheet of rigid polymethylmetacrylate (Plexiglas) or of flexible polyester, preferably 76 or 100 μm thick. Dots or areas of paint are then applied to said sheet, using, for example, a so-called nitrosynthetic paint, preferably transparent and colored, and allowed to dry. The paint is applied using a board with pointed projections in a punctiform or linear pattern, which will hereafter be called the "cliché". The cliché is partially immersed in a tank containing the paint or plastic, then raised and lowered onto the base sheet. The cliché is them raised and the sheet with the application is allowed to dry. The sheet with the decoration can then be used alone, or incorporated into a panel with transparent surfaces, or else incorporated into a panel with a mirror surface facing the sheet; or otherwise a plurality of sheets, preferably with a different arrangement of the applications, can be assembled to form a panel. The sheet and the panel constitute new products. The process and the device make it possible to obtain the product industrially, in a practical and economical manner.

An exemplary embodiment will be described hereunder with reference to the attached drawings in which:

FIG. 1 is a front view of a first embodiment of a device, or "cliché", used for the process;

FIG. 2 is an enlarged sectional view taken along a plane indicated by 2—2 in FIG. 1;

Figure 3:
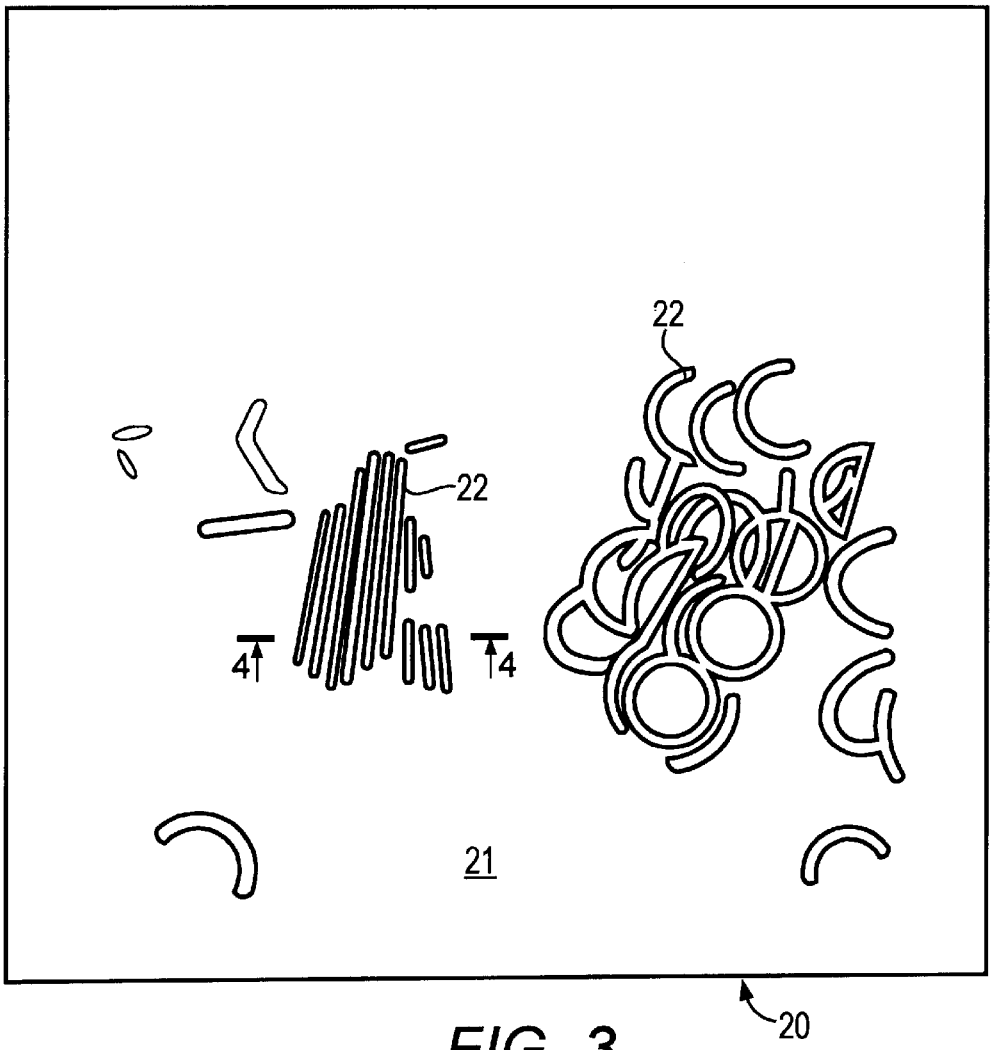
FIG. 3 is a front view of a second embodiment of the device or "cliché" used for the process.
Figure 4:
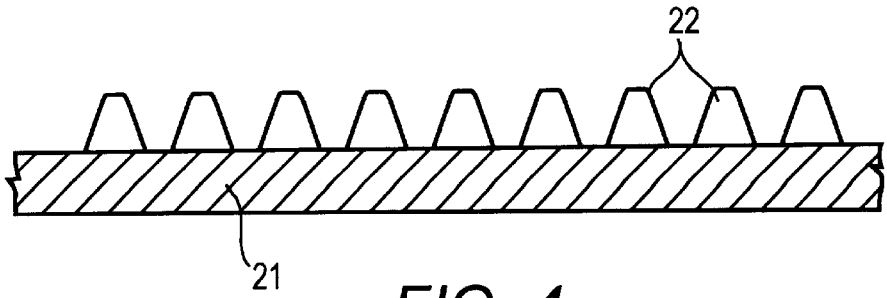
FIG. 4 is an enlarged sectional view taken along a plane indicated by 4—4 in FIG. 3.

Some embodiments of devices or clichés used for the process will first be described.

The cliché referenced 10 in FIG. 1 comprises a stiff base board 11 on which are applied conical or in any case tapered points or portions referenced 12, with chamfered tips. The points 12 can be part of a sheet of material 13 thus obtained, as in the example in FIG. 2; or else they can be made up of nails or the like applied at suitable points of the base board.

A cliché 20 shown in FIG. 3 comprises a plurality of linear portions with a tapered cross section, referenced 22, applied to a base board 21. The linear portions can have any shape, for example they can extend in a straight line, or in a semi-circle or according to any desired curve. It is also possible to obtain clichés with tapered punctiform or linear shapes on the same table.

According to the process of the invention, a cliché 10 or 20 or of any kind desired is lowered onto a tank containing liquid or semiliquid printing material (not shown). What is meant by printing material in this context is a paint or plastic material; nitrosynthetic paints or any synthetic resin that can be colored can be used: polyesters, polyurethanes, epoxy materials, UV adhesives for glass.

The cliché is dipped in the liquid contained in the tank so as to bathe only the points 12 and/or 22, then it is raised and translated onto the vertical of a base sheet or plate of transparent plastic material onto which it is lowered. Alternatively the base sheet of plastic material can be moved with respect to the cliché.

Figure 5:
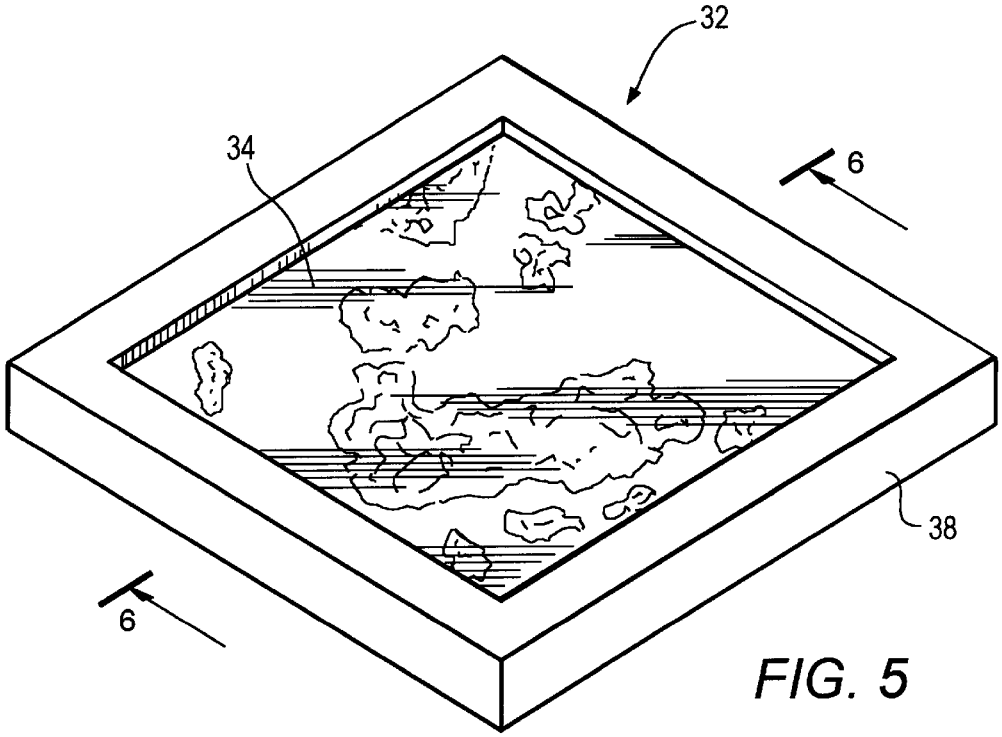
FIG. 5 is a perspective view of a panel obtained by the process of the invention.
Figure 6:
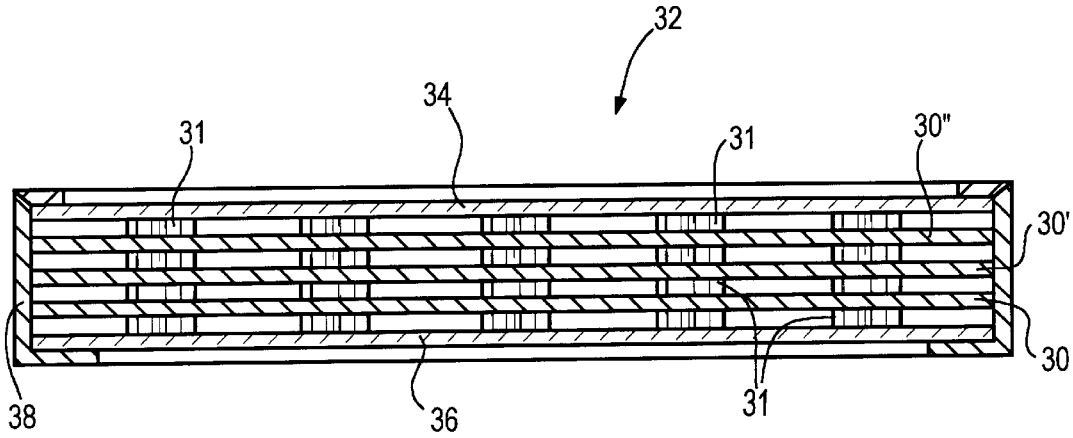
FIG. 6 is a sectional view taken along a plane indicated by 6—6 in FIG. 5.
Figure 7:
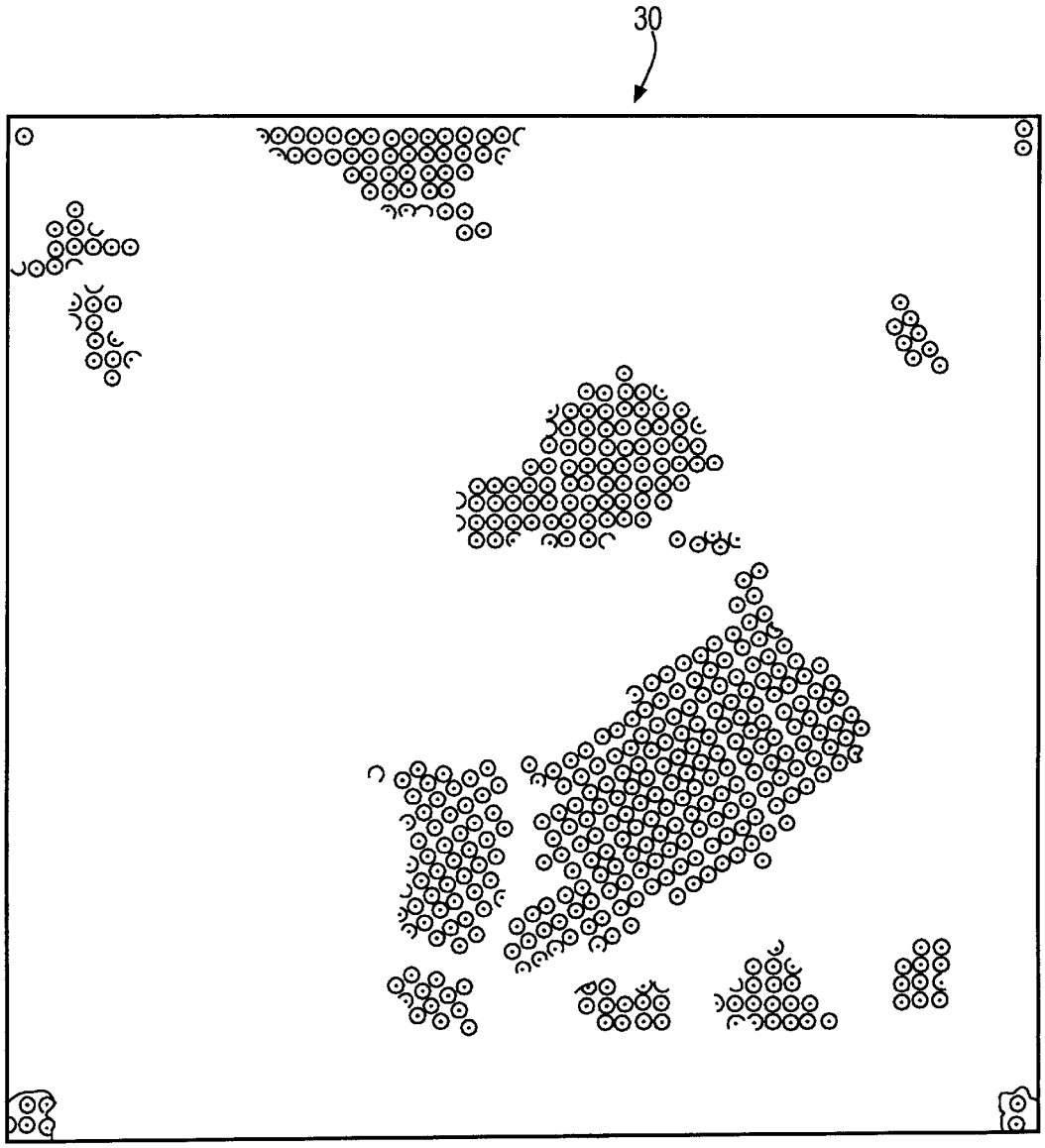
FIG. 7 is a view of a sheet product obtained.

The cliché is then raised again and brought back onto the vertical of the tank for a subsequent cycle. The base sheets with the application of paint or plastic are then allowed to dry or dried. The sheets 30 (FIG. 7) thus provided with the application can be used as an end product for decoration or furnishing, or they can be made into panels by combining them with a frame and, for example, a mirror back board and a transparent protective board. Alternatively, the invention also provides for a panel 32 (FIGS. 5 and 6) comprising a combination of decorated sheets 30, 30', 30" (possibly spaced out from each other by distance pieces 31 consisting, for example, of small circles or hollow cylinders or other shape of transparent plastic), and transparent boards 34 on both faces in contact with the outside or on at least one of them, whilst the other can have a mirror board, 36; the whole being assembled by means of a frame 38.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A decorative device, comprising:

(a) a first substrate; and (b) a plurality of spaced apart, overlapping decorated sheets, wherein each of the sheets includes a plurality of design elements of differing shapes.

2. A device according to claim 1, wherein each of the plurality of spaced apart, overlapping decorated sheets includes a printing material engaging a glass substrate.

3. The device of claim 1, further comprising a second substrate located on one side of the decorated sheets with the first substrate being located on the other side of the decorated sheets and a C-shaped frame member enclosing peripheral edges of the sheets and the first substrate and second substrate, the frame member having edges projecting interiorly and engaging an exterior side of each of the first substrate and second substrate to form a structure enclosing the decorated sheets.

4. The device of claim 1, wherein each of the decorative sheets has a design formed by the design elements and the design elements include shapes selected from the group consisting of punctiform, straight, curvilinear, and combinations thereof.

5. A device according to claim 1, wherein the first substrate is a mirror board.

6. A device according to claim 5, further comprising a transparent protective board located above the mirror board.

7. A device according to claim 1, further comprising a plurality of distance pieces located in between the plurality of spaced apart, overlapping decorated sheets.

8. The device of claim 7, wherein the distance pieces have a circular shape and are transparent.

9. A decorative device, comprising:

(a) a first substrate; and (b) a plurality of spaced apart, overlapping decorated sheets, wherein the first substrate is a mirror board.

10. A device according to claim 9, further comprising a plurality of distance pieces located in between the plurality of spaced apart, overlapping decorated sheets.

11. A device according to claim 9, wherein each of the plurality of spaced apart, overlapping decorated sheets includes a printing material engaging a glass substrate.

12. The device of claim 9, further comprising a second substrate located on one side of the decorated sheets with the first substrate being located on the other side of the decorated sheets and a C-shaped frame member enclosing peripheral edges of the sheets and the first substrate and second substrate, the frame member having edges projecting interiorly and engaging an exterior side of each of the first substrate and second substrate to form a structure enclosing the decorated sheets.

13. A decorated device, comprising:

(a) a first substrate; and (b) a plurality of spaced apart, overlapping decorated sheets, wherein each of the plurality of spaced apart, overlapping decorated sheets includes a printing material engaging a glass substrate.

14. A device according to claim 13, wherein the first substrate is a mirror board.

15. A device according to claim 13, further comprising a plurality of distance pieces located in between the plurality of spaced apart, overlapping decorated sheets.

16. A device according to claim 13, further comprising a second substrate located on one side of the decorated sheets with the first substrate being located on the other side of the decorated sheets and a C-shaped frame member enclosing peripheral edges of the sheets and the first substrate, the frame member having edges projecting interiorly and engaging an exterior side of each of the first substrate and second substrate to form a structure enclosing the decorated sheets.

17. A decorative device, comprising:

(a) top and bottom protective boards, wherein the top protective board is transparent; and (b) a frame engaging the top and bottom protective boards, wherein each of the boards is spaced from a decorative sheet located between the boards and enclosed by the frame wherein the decorative sheet includes a plurality of design elements of differing shapes.

18. A device according to claim 17, further comprising a plurality of spacers located in between the decorative sheet and the top and bottom protective boards.

19. A device according to claim 18, wherein the bottom board is a mirror board.

20. The device of claim 18, wherein the spacers have a circular shape and are transparent.

21. A device according to claim 18, wherein the decorative sheet includes a plurality of decorative sheets apart by a plurality of spacers.

22. The device of claim 21, wherein each of the decorative sheets has a design and the design is formed by the plurality of design elements each of which has a punctiform shape, straight shape, curvilinear shape, and combinations thereof.

23. The device of claim 21, wherein the frame is C-shaped and encloses peripheral edges of the sheets and the protective boards, the frame member having edges projecting interiorly and engaging an exterior side of each of the protective boards to form a structure enclosing the sheets.

24. The device of claim 23, further comprising a plurality of spacers located in between each of the board and the sheet adjacent to each of the boards and in between each pair of sheets that are adjacent to one another.

25. A decorative device, comprising:

(a) top and bottom protective boards, wherein the top protective board is transparent; and (b) a frame engaging the top and bottom protective boards, wherein each of the boards is spaced from a decorative sheet located between the boards and enclosed by the frame, (c) a plurality of spacers located in between the decorative sheet and the top and bottom protective boards, wherein the bottom board is a mirror board.

26. A decorative device, comprising:

(a) a top, transparent board;

(b) a bottom, mirrored board;

(c) a frame engaging the boards, the frame having upper and lower interiorly facing edges, the upper edge engaging an exterior side of the top board and the lower edge engaging an exterior side of the bottom board;

(d) a plurality of spaced apart decorative sheets enclosed by the boards and the frame; and (e) a plurality of transparent distance pieces located in between and engaging the spaced apart decorative sheets and in between and engaging a respective board and an adjacent decorative sheet.

* * * * *

UNITED STATES PATENT AND TRADEMARK OFFICE

CERTIFICATE OF CORRECTION

PATENT NO. : 6,185,892 B1
DATED : February 13, 2001
INVENTOR(S) : Marco Calvanella It is certified that error appears in the above-identified patent and that said Letters Patent is hereby corrected as shown below:

Column 3, claim 16,
Line 39, after "substrate" insert -- and second substrate -- therein.

Column 4, claim 21,
Line 9, after "decorative sheets" insert -- spaced -- therein.

Column 4, claim 24,
Line 22, delete "board" and insert -- boards -- therein.

Signed and Sealed this

Eighth Day of January, 2002

*Attest:*

*Attesting Officer*

JAMES E. ROGAN
*Director of the United States Patent and Trademark Office*